US006113415A

United States Patent [19]

Bertsch et al.

[11] Patent Number: 6,113,415

[45] Date of Patent: Sep. 5, 2000

[54] ELECTRICAL CONNECTOR FOR CONNECTING AT LEAST TWO PLUGS TO A COMMON SOCKET

[75] Inventors: Michael Bertsch, Heilbronn; Stephan Langer, Schwaigern; Rainer Link, Ilsfeld; Wolfram Zuck, Siegelsbach, all of Germany

[73] Assignee: Amphenol-Tuchel Electronics GmbH, Heilbronn, Germany

[21] Appl. No.: 09/203,734

[22] Filed: Dec. 2, 1998

[51] Int. Cl.[7] ..... H01R 13/627

[52] U.S. Cl. ..... 439/353; 439/357; 439/701

[58] Field of Search ..... 439/358, 594, 439/701, 357, 717, 353

[56] References Cited

U.S. PATENT DOCUMENTS

| | | | |
|---|---|---|---|
| 4,405,192 | 9/1983 | Eaby et al. | 439/358 |
| 5,213,533 | 5/1993 | Walden | 439/358 |
| 5,486,117 | 1/1996 | Chang | 439/357 |
| 5,564,939 | 10/1996 | Maitani et al. | 439/357 |
| 5,569,047 | 10/1996 | Pauza et al. | 439/353 |
| 5,634,809 | 6/1997 | Hirai | 439/357 |
| 5,772,475 | 6/1998 | Lindeberg et al. | 439/701 |
| 5,797,771 | 8/1998 | Garside | 439/358 |
| 5,876,252 | 3/1999 | Hahn et al. | 439/701 |
| 5,895,296 | 4/1999 | Okabe | 439/701 |
| 5,904,598 | 5/1999 | Yamanashi | 439/701 |

FOREIGN PATENT DOCUMENTS

| | | | |
|---|---|---|---|
| 44 44 423 | 6/1996 | Germany | H01R 13/703 |

*Primary Examiner*—Neil Abrams
*Assistant Examiner*—Hae Moon Hyeon
*Attorney, Agent, or Firm*—Blank Rome Comisky & McCauley LLP

[57] ABSTRACT

The invention concerns a connector assembly for connecting at least two plugs having contacts on their plug-in side to a common socket having corresponding counter contacts. The connector assembly includes at least a first and second plug having a guiding member and guiding receptacle for mating the plugs and inner and outer catching members for mating to a common socket. The inner catching members have enlarged portions which cause these members to be pushed into an unlockable position with respect to the socket when the plugs are mated together.

7 Claims, 1 Drawing Sheet

ELECTRICAL CONNECTOR FOR CONNECTING AT LEAST TWO PLUGS TO A COMMON SOCKET

DESCRIPTION

Figure 1:
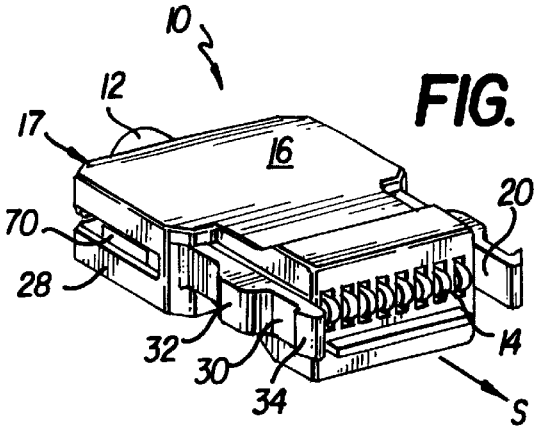

The invention concerns a connector for connecting at least two plugs having contacts on their plug-in side to a common socket having corresponding counter contacts.

For example, in computers, mobile phones or entertainment electronics devices, in particular for a so-called multimedia application, it is necessary for example for data transmission to plug several plugs onto corresponding sockets on the equipment.

Here, the plugs can be secured to the associated sockets in different ways. From the DE 44 44 423 A1 a plug-in device is known, wherein the plug has lateral catch pins, which catch with corresponding catch openings on the socket.

If several plugs are necessary, a corresponding clearance has to remain between the plugs to ensure the guidance and the locking of the plugs.

However, in the case of cramped conditions, for example in a mobile phone, such an additional space is often not available.

In this respect, it is an object of the invention to show a possibility to position several plugs immediately side by side in a space as small as possible, but wherein it also has to be possible to secure individual plugs to the associated socket In the case of the plug known from the DE 44 44 423 A1, an immediate positioning of adjacent plugs is not possible, because the corresponding lateral catch arms are formed resiliently and require space, accordingly.

The invention starts out from the consideration to adapt the plug known from the DE 44 44 423 A1 so that, if two plugs are intended to be assembled immediately side by side, to render the "inner catch arms" without function, that is only the outer catch arms will bring about the joint locking of adjacent plugs and the adjacent plugs are positioned against their corresponding surface portions between each other at the same time.

Therefore, in a connector of two plugs, each having two catching members, two of the four catching members are rendered without function and only the outer catching members are necessary for securing them.

Considered in an idealized manner, the two slugs disposed side by side are virtually connected into one plug which is secured to the socket by two outer catching members.

In its most general embodiment, the invention concerns a connector for connecting at least two plugs having contacts on the plug-in surface to a common socket having corresponding counter contacts, and having the following features:

each plug has a resilient outer catching member extending in the direction of insertion along at least one outer surface, at least a first plug has along an inner surface opposing the outer surface a guiding receptacle and an inner resilient catching member situated in front of the receptacle, in the direction of insertion, an enlarged portion of the inner catching member projects beyond the inner surface of the plug, at least another plug has along an inner surface opposing the outer surface a guiding member corresponding to the guiding receptacle and a portion situated in front of the guiding member, in the direction of insertion, an enlarged portion of which projects beyond the inner surface of the other plug.

According to the first part feature, each plug has along at least one outer surface an outer catching member. This outer catching member is necessary for locking the plug to a corresponding socket, regardless of whether the plug is used alone or together with a second or third plug. The outer catching members have only this function.

According to an embodiment, the plugs have on their surface opposing the said outer surface also a corresponding catching member. Such a plug corresponds largely to that according to DE 44 44 423 A1.

In developing the known the plug, according to the invention it is provided according to the second part feature to dispose a guiding receptacle in front of the catching member in the direction of insertion on the side of the second catching member (called inner surface below). The guiding receptacle serves for receiving a corresponding guiding member of another plug and thus for connecting both plugs immediately under positive fit. The originally separate plugs arc connected virtually to a joint plug and mutually stabilized thereby.

However, for the reasons mentioned above, the said inner resilient catching member would interfere in connecting the two plugs.

In this respect, the third part feature provides to form this inner catching member having an enlarged portion projecting laterally (in the direction towards the adjacent plug) beyond the rest of the inner surface.

Correspondingly, it is provided according to the fourth part feature to form the corresponding inner surface of the other plug also with an enlarged portion so that in axially inserting the guiding member of one of the plugs into the guiding receptacle of the other plug, the enlarged portions run against each other and thus push the corresponding catching member away perpendicularly with respect to the direction of insertion so that it may still be inserted into the corresponding catch opening (usually in the socket) in further inserting the plug, but does not lock their any more.

In the embodiment mentioned above, a plug (the other plug) is formed having only one catching member, the said enlargement being disposed on the opposing shell portion (the inner surface).

However, according to an embodiment, it is provided that the portion of the other plug, having the enlarged portion is also formed by an inner resilient catching member. In this case, inserting and locking the adjacent plug accordingly results in that both inner catching members are pushed laterally away (in the direction towards the corresponding catching members of each plug, respectively) and thus do not perform their locking function (according to the object) any more.

It arises from the description above that the function of the respective catching member/members will not be affected in plugging-on an individual plug, that is the so-called first plug as well as the other plug.

It follows from the above that the plugs should be flattened at least on their (inner) surface portions which lie against each other in a joint assembly, because a particularly favorable plane fitting of the adjacent plugs is made possible thereby.

Accordingly, the plugs typically have a rectangular cross section, for example.

The connector described above makes it possible to assemble two or more plugs in a common socket having corresponding counter contacts, although separate sockets are possible too.

Altogether, not only the "width" of the plugs to be arranged side by side is decreased but also the constructive requirement for the socket is reduced For example, the socket may be bridge-shaped and have several portions with different numbers of counter contacts, the number of which corresponds to the number of contacts of the associated plugs.

A typical case of application of the said connector is a mobile phone. Here, for example, the power supply may be effected through a plug. The other plug may be used as signalling plug, for example for a fax connection.

Principally, the catching members may have any shape. According to an embodiment, it is provided to form the catching members as catch arms—like those in the DE 44 44 423 A1—which extend in the direction of insertion of the plug and have catching means at their free end, which face towards the outside, for example. The free ends of the catching means may project beyond the contacts of the plug towards the front (in the direction of insertion).

Each of the catch arms are formed resiliently to be able to perform the locking function.

For the guiding receptacle it is only necessary that it performs the function to receive securely the associated guiding member of the other plug and to connect both plugs with form fit. The guiding receptacle of the first plug may consist of a groove extending in the direction of insertion, whereas the guiding member of the other plug has a tongue-like shape. Thus, the tongue may be inserted into the groove with form fit in pushing-on the other plug. The groove may have a T- or dovetail shape and the guiding member is formed having a corresponding shape.

If it is desired, another locking may be effected in the region of the guiding receptacle/the guiding member.

For that an embodiment provides to dispose a resilient locking member in the guiding receptacle, which holds releasably the guiding member after insertion into the guiding receptacle.

Again, this locking member may be a catch arm lying resiliently in the guiding receptacle.

In order to guarantee an accurate positioning of adjacent plugs, it is useful, if the guiding receptacle has a stop for the guiding member, at its front end in the direction of insertion. This stop is disposed appropriately so that the contacts of both plugs are situated in a common plane, in the assembled condition.

Otherwise, the plugs, the contacts of the plugs, the socket, and the counter contacts of the socket may have any design.

Further characteristics of the invention arise from the features of the subclaims as well as the other application documents.

In the following, the invention is described in more detail with an embodiment. The figures show—each in schematic representation FIG. 1 a perspective view of a first plug, FIG. 2 a perspective view of another plug, FIG. 3 a perspective view of the plugs according to FIGS. 1, 2, locked to each other, in allocation to a socket, FIG. 4 the arrangement according to FIG. 3 in a plan view.

In FIG. 1 the reference number 10 indicates a first plug having essentially a rectangular cross section.

At the rear end in the figure, a cable connection 12 can be seen. At the front end, there are illustrated a total of eight resilient contacts 14. Thus, the plug 10 is an 8-pin plug.

On the right side in the figure (called outer surface 18 below), a catch arm 20 is articulated.

Figure 4:
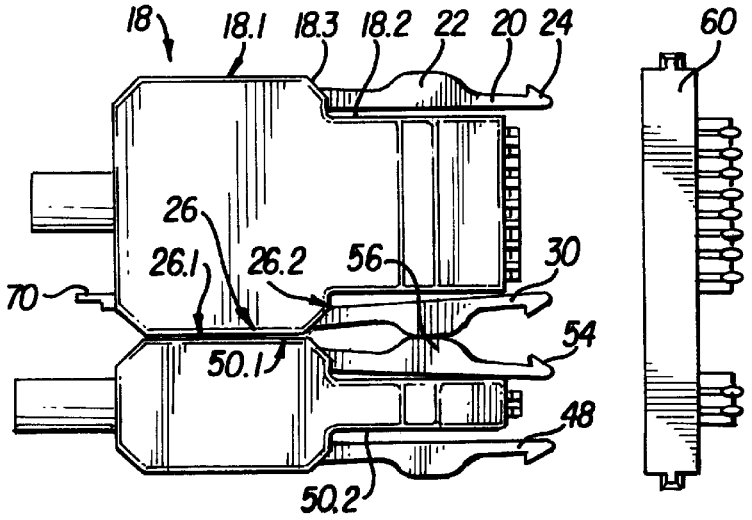

FIG. 4 shows that the outer surface 18 has a first portion 18.1 (adjacent to the cable 12) and an inwardly offset portion 18.2 disposed in front of the first portion, in the direction of insertion (arrow S).

The catch arm 20 extends from a connection portion 18.3 between the portions 18.1 and 18.2 approximately in parallel with the portion 18.2 and projects forwardly (in the direction of insertion) beyond the contacts 14.

The catch arm 20 has an enlargement 22 approximately in the middle of the outer surface and a detent 24 directed outwardly, at its free end.

The surface opposing the outer surface 18 (called inner surface 26 below) is formed in correspondence with the outer surface 18 (FIG. 4). However, the portion 26.1 corresponding to the portion 18.1 has a guiding groove 28 extending in the direction of insertion and having approximately a T-shaped cross section.

Another (inner) catch arm 30 extends in laterally reversed manner to the catch arm 20 from the portion 26.3 of the inner surface 26, corresponding to the portion 18.3.

Accordingly, the catch arm 30 has an enlargement 32 as well as a detent 34 at the end.

The enlargements 22, 32 are formed to project beyond the portions 18.1 and 26.1 of the outer surface 18 and the inner surface 26, respectively, in the no-load condition of the plug 10.

Figure 2:
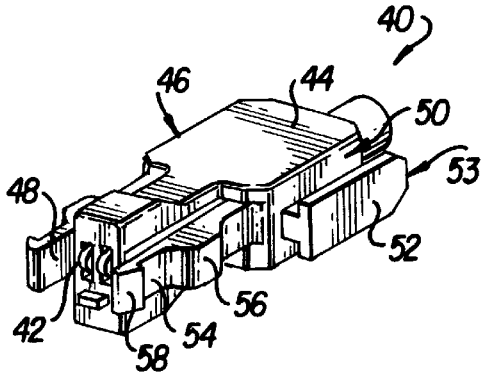
Figure 3:
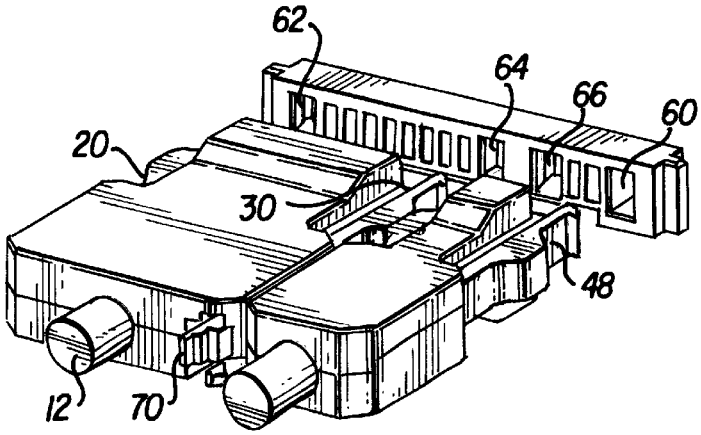

FIG. 2 shows another plug 40 which is formed as a 2-pin plug (two contacts 42) and the shall 44 of which corresponds basically to the shape of shell 16 of the plug 10. But the plug 40 is narrower because of the 2-pin design.

The outer surface being illustrated in FIG. 2 to the left is designed in correspondence to the outer surface 18 of the plug 10. This is also true for an outer catch arm 48 disposed on the outer surface 46. In this respect, it is referred to the description of FIG. 1.

Again, the opposing surface (called inner surface 50 below) in its basic structure is designed in a laterally reversed fashion to the outer surface 46, as is shown in FIG. 4. The plug 40 has a tongue-like guiding member 52 in its portion 50.1, which has a shape corresponding to the T-shape of the guiding groove 28.

The portion 50.2 of the inner surface 50, situated in front of the portion 50.1 in the direction of insertion is formed in correspondence with the inner surface 26 of the plug 10 so that reference is made to the corresponding description of the plug 10, too.

Accordingly, this portion 50.2 has another catch arm 54 having an enlargement 56 and a detent 58 at the end.1 If only one plug (10 or 40) is put onto the corresponding socket 60, this is done in a conventional manner and the locking of the plug 10 on the socket 60 is effected, for example, through the catch arms 20, 30 in corresponding catch openings 62, 64 of the socket 60.

But if both plugs 10, 40 are to be arranged in an immediately adjacent relationship (FIG. 3, 4), the plug 40 is guided into the guiding groove 28 via the guiding member 52, until the front end of the guiding member abuts the portion 18.3 of the plug 10. In this relative displacement of the two plugs 10, 40 the corresponding enlargements 32, 56 of the catch arms 30, 54 run against each other so that the catch arms 30, 54 are pushed outwardly (in the direction towards the opposite catch arms 20 and 48, respectively (FIG. 4)). The plugs 10, 40 being thus assembled jointly are then put upon the socket 60 and the locking is effected through the outer catch arms 20, 48, respectively, whereas the "inner catch arms" 30, 54 remain ineffective, since the corresponding detents 34, 58 cannot be locked any more in the catch openings 64, 66 of the socket 60.

As indicated schematically in FIGS. 1 and 4, a locking member 70 extends in the region of the guiding groove 28, which projects beyond the rear face 17 of the shell 16 of the plug 10 and has a detent there, which reaches behind the rear face 53 of the guiding member 52 in the totally inserted condition of the plug 40 and fixes additionally the two plugs 10, 40.

What is claimed is:

1. A connector assembly for connecting at least two plugs having contacts on a plug-in side to a common socket having corresponding counter contacts, having the following features:

each plug has a resilient outer catching member extending in the direction of insertion of the plug into the socket along at least one outer surface, at least a first plug is provided along an inner surface opposing the outer surface with a guiding receptacle and an inner resilient catching member placed in front of the receptacle, in said direction of insertion, an enlarged portion of the inner catching member projects beyond the inner surface of the plug, at least a second plug has along an inner surface opposing the outer surface a guiding member for mating with the guiding receptacle of said first plug and an inner resilient catching member situated in front of the guiding member, in said direction of insertion, an enlarged portion of which projects beyond the inner surface of the second plug such that when the guiding member on said second plug is mated with the guiding receptacle on said first plug the enlarged portions of the inner resilient catching members abut against one another and push the inner resilient catching members into an unlockable position with respect to the socket.

2. The connector according to claim 1, wherein the catching members consist of catch arms extending in said direction of insertion of the plug and having catching means at their free end.

3. The connector according to claim 1, wherein the guiding receptacle of the first plug consists of a groove extending in said direction of insertion and the guiding member of the second plug consists of a tongue being able to be pushed in said direction of insertion into the groove of the guiding receptacle under positive fit.

4. The connector according to claim 1, wherein a resilient locking member is disposed within the guiding receptacle, which detachably secures the guiding member after insertion into the guiding receptacle.

5. The connector according to claim 1, wherein the guiding receptacle has a stop for the guiding member at the front end in said direction of insertion.

6. The connector according to claim 1, wherein the catching members project forwardly beyond the contacts of the plugs.

7. The connector according to claim 1, wherein the guiding receptacle has a T-shaped or dovetail guide for a guiding member having a corresponding shape.

* * * * *

UNITED STATES PATENT AND TRADEMARK OFFICE

CERTIFICATE OF CORRECTION

PATENT NO. : 6,113,415

DATED : September 5, 2000

INVENTOR(S) : Michael BERTSCH et al.

It is certified that error appears in the above-identified patent and that said Letters Patent is hereby corrected as shown below:

On the face of the patent, left-hand column, third line of "[75]", change "Ilsfeld" to –Illsfeld–.

On the face of the patent, left-hand column, after line "[22]" insert:

–[30] Foreign Application Priority Data

Dec. 3, 1997 [DE] Germany ..... 197 53 521.6–.

Column 1, line 28, after "socket" insert –.--

Column 2, line 38, change "their any more" to –there anymore–.
line 51, change "any more" to –anymore–.

Column 3, line 3, after "reduced" insert –.--

Column 4, line 29, change "shall" to –shell–.
line 50, change "end.1" to –end 1.–.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*